US008579431B2

(12) United States Patent
Asada et al.

(10) Patent No.: US 8,579,431 B2
(45) Date of Patent: Nov. 12, 2013

(54) IMAGE PRINTING APPARATUS

(75) Inventors: Tetsuo Asada, Kuwana (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 306 days.

(21) Appl. No.: 13/072,732

(22) Filed: Mar. 27, 2011

(65) Prior Publication Data

US 2011/0242182 A1 Oct. 6, 2011

(30) Foreign Application Priority Data

Mar. 30, 2010 (JP) ..... 2010-078814

(51) Int. Cl.
*B41J 2/01* (2006.01)

(52) U.S. Cl.
USPC ..... 347/104; 347/101

(58) Field of Classification Search
USPC ..... 347/101, 104
See application file for complete search history.

(56) References Cited

U.S. PATENT DOCUMENTS 7,165,902 B2 * 1/2007 Ejiri et al. ..... 400/625
2004/0017459 A1 * 1/2004 Kawaguchi et al. ..... 347/104
2005/0068360 A1 3/2005 Hess et al.
2009/0309942 A1 * 12/2009 Sugiyama ..... 347/104
2010/0289207 A1 * 11/2010 Mano ..... 271/3.14
2011/0110698 A1 * 5/2011 Yamanaka ..... 400/578

FOREIGN PATENT DOCUMENTS

JP 2001-039557 A 2/2001
JP 2005-104150 A 4/2005
JP 2006-091947 A 4/2006

* cited by examiner

*Primary Examiner* — Julian Huffman
*Assistant Examiner* — Sharon A Polk
(74) *Attorney, Agent, or Firm* — Baker Botts L.L.P.

(57) ABSTRACT

An image printing apparatus includes an image printing unit, a manual feed tray and a feeding mechanism. The manual feed tray is configured to receive a first printing medium to be fed and is movable between a feeding position and a retracted position. The feeding mechanism is configured to feed a specific tray, on which a second printing medium is mounted, from an inlet to the image printing unit through a first path. The feeding mechanism is further configured to feed the first printing medium received by the manual feed tray to the image printing unit through a second path different from the first path. The image printing apparatus further includes a sensor configured to detect a current position of the manual feed tray. The image printing apparatus performs printing on the second printing medium mounted on the specific tray on the basis of the current position of the manual feed tray detected by the sensor.

14 Claims, 8 Drawing Sheets

IMAGE PRINTING APPARATUS

CROSS REFERENCE TO RELATED APPLICATION

The present application claims priority from Japanese Patent Application No. 2010-078814, filed on Mar. 30, 2010, the disclosure of which is incorporated herein by reference in its entirely.

BACKGROUND

1. Technical Field

The present invention relates to an image printing apparatus configured to feed a specific tray on which a printing medium is mounted.

2. Related Art

An image printing apparatus configured to feed a specific tray, on which a printing medium such as a DVD is placed, from the front opening of the apparatus body is known. The image printing apparatus performs image printing (label printing) on a front surface of the printing medium and then returns the tray back to the front opening. It may be difficult to reduce the size of the image printing apparatus because of the complication caused by the fed tray and other objects of the image printing apparatus.

SUMMARY

A need has arisen to provide an image printing apparatus which may be able to execute label printing and further may has a reduced size.

According to an embodiment of the present invention, an image printing apparatus comprises an image printing unit, a manual feed tray and a feeding mechanism. The manual feed tray is configured to receive a first printing medium to be fed and is movable between a feeding position where the first printing medium can be fed and a retracted position. The feeding mechanism is configured to feed a specific tray, on which a second printing medium is mounted, from an inlet to the image printing unit through a first path. The feeding mechanism is further configured to feed the first printing medium received by the manual feed tray to the image printing unit through a second path different from the first path. The image printing apparatus further comprises a sensor configured to detect a current position of the manual feed tray. The image printing apparatus still further comprises a controller configured to control the feeding mechanism and the image printing unit to perform printing on the second printing medium mounted on the specific tray on the basis of the current position of the manual feed tray detected by the sensor.

According to an embodiment of the present invention, the image printing apparatus comprises an image printing unit and a feeding mechanism. The feeding mechanism is configured to feed a specific tray, on which a printing medium is mounted, from an inlet to the image printing unit in a first direction. The image printing apparatus further comprises a detecting device configured to detect whether a space is existing outside the apparatus in the first direction. The image printing apparatus still further comprises a controller configured to control the feeding mechanism and the image printing unit to perform printing on the printing medium mounted on the specific tray when the detecting device detects that the space is existing and not to perform printing on the printing medium mounted on the specific tray when the detecting device detects that the space is not existing.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DESCRIPTION OF THE PREFERRED EMBODIMENTS

Figure 1:
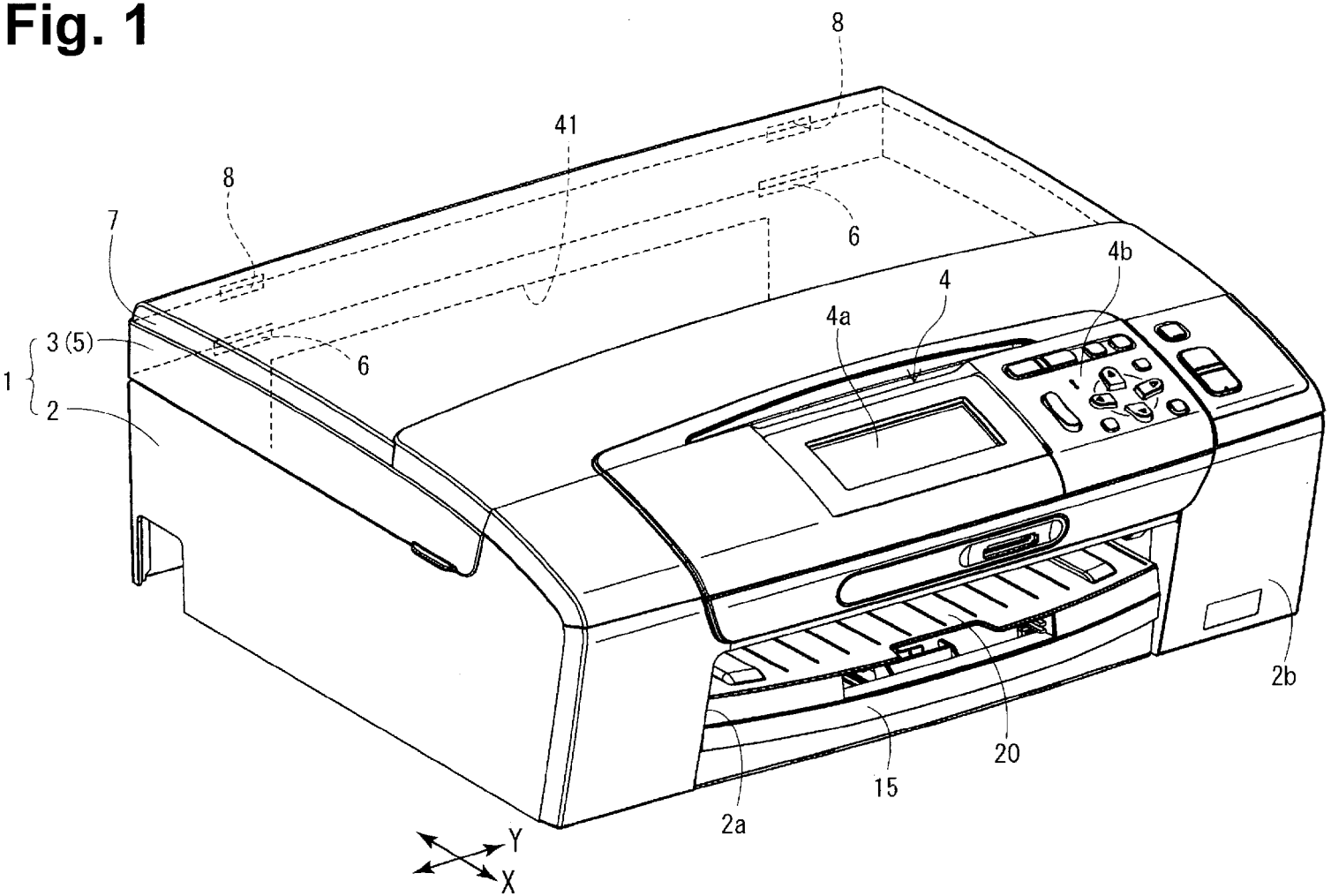
FIG. 1 is a perspective view of a front side of an image printing apparatus to which the invention is applied.
Figure 2:
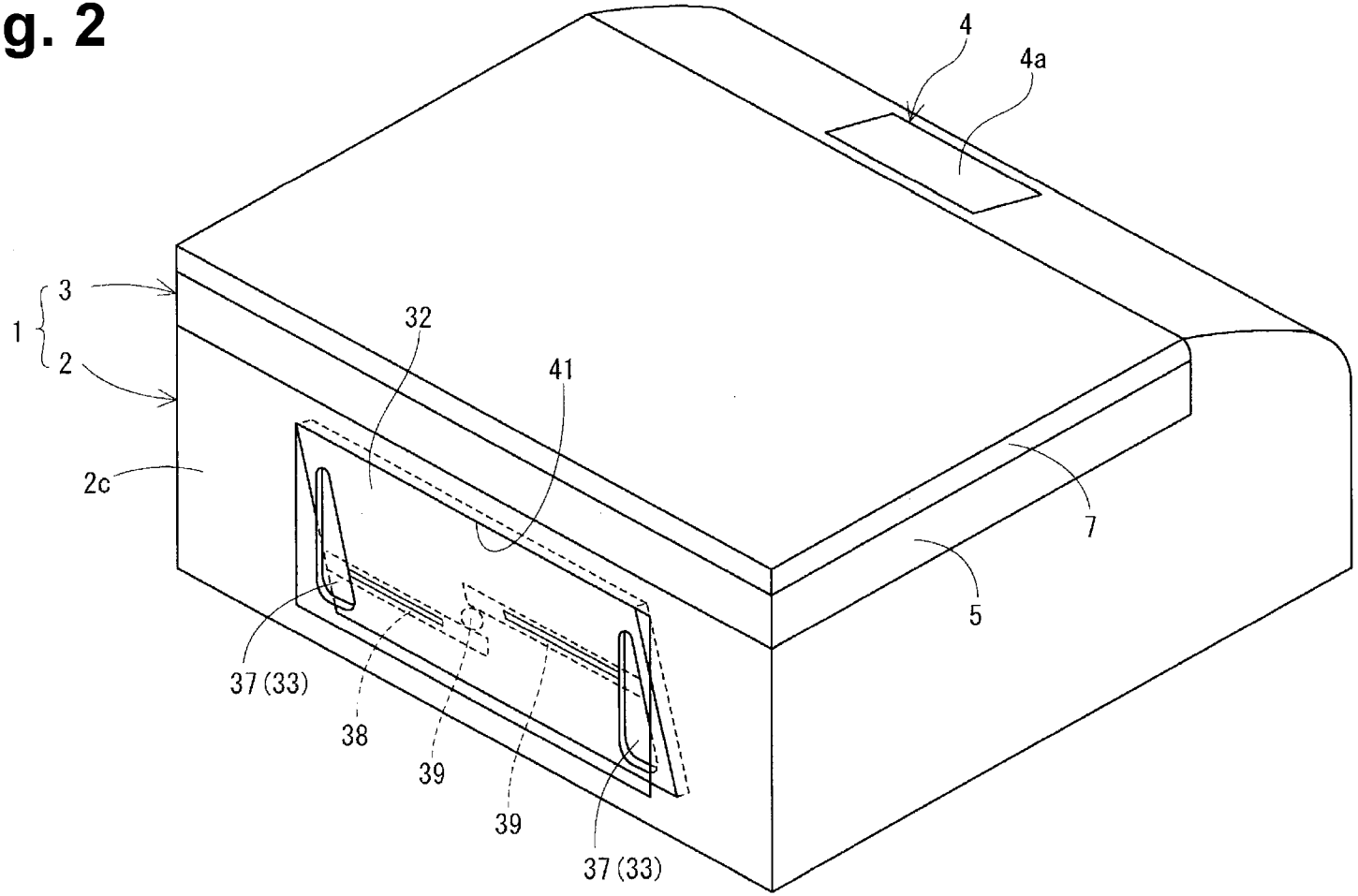
FIG. 2 is a perspective view of a back side of the image printing apparatus.

Embodiments of the invention and their features and advantages may be understood by referring to FIGS. 1-8, like numerals being used for like corresponding parts in the various drawings. Preferred embodiments of the present invention will be described below with reference to the accompanying drawings.

An image printing apparatus 1 as an example of an electric apparatus is a Multi Function Device (MFD) having a printing function, a copying function, a scanner function, and a facsimile function. In the first example shown in FIG. 1, a housing 2 as an apparatus body in the image printing apparatus 1 is provided. The housing 2 is made up of an injection-molded product formed of synthetic resin.

[Basic Configuration of Image Printing Apparatus]

On an upper surface of the housing 2, an upper body 3 which is made up of an injection-molded product formed of synthetic resin is mounted to an end of the housing 2 via first hinge portions 6 so as to be rotatably openable and closable in the vertical direction. In other words, when a front opening 2*a* is formed on a front side of the housing 2 (a right front side in FIG. 1), a pivotal axis as an axial line of rotation of the upper body 3 with respect to the housing 2 is positioned on a back side of the housing 2, which is the farthest from the front opening 2*a*. Arranged on the upper surface of the housing 2 at a portion near the front is an operating panel portion 4 having a display panel 4*a* and an operating switch 4*b*. The expressions "left" and "right" ("left side" and "right side") mean the left and the right with respect to the housing 2 or the image printing apparatus 1 when opposing the front side (the side of the front opening 2*a*) of the housing 2 (hereinafter).

An image scanning apparatus 5 used for the copying function and the facsimile function is integrated in the upper body 3. The image scanning apparatus 5 includes a glass plate for placing documents thereon and a tight-contact image sensor (CIS: Contact image Sensor) for scanning the document arranged underside of the glass plate (both not shown). A document cover member 7 covers an upper surface of the glass plate and presses the document. The tight-contact image sensor is provided so as to be reciprocally movable along a guide shaft extending in a Y-axis direction in FIG. 1. A rear end of the document cover member 7 which covers an upper surface of the image scanning apparatus 5 is rotatably connected to a back side of the upper body 3 so as to be openable and closable via third hinge portions 8.

On the other hand, a lid member 2*b* for an ink storage section is provided on one side of the housing 2 (a front surface having the front opening 2*a*) so as to be openable toward the front. In the ink storage section, cartridges for individual colors, that is, ink cartridges for respective colors, not shown, namely, black (Bk), Cyan (C), Magenta (M), and yellow (Y) in this embodiment, are stored. The respective ink cartridges and ink-jet printheads 14 in an image printing unit 12 are connected with flexible ink supply tubes.

Figure 3:
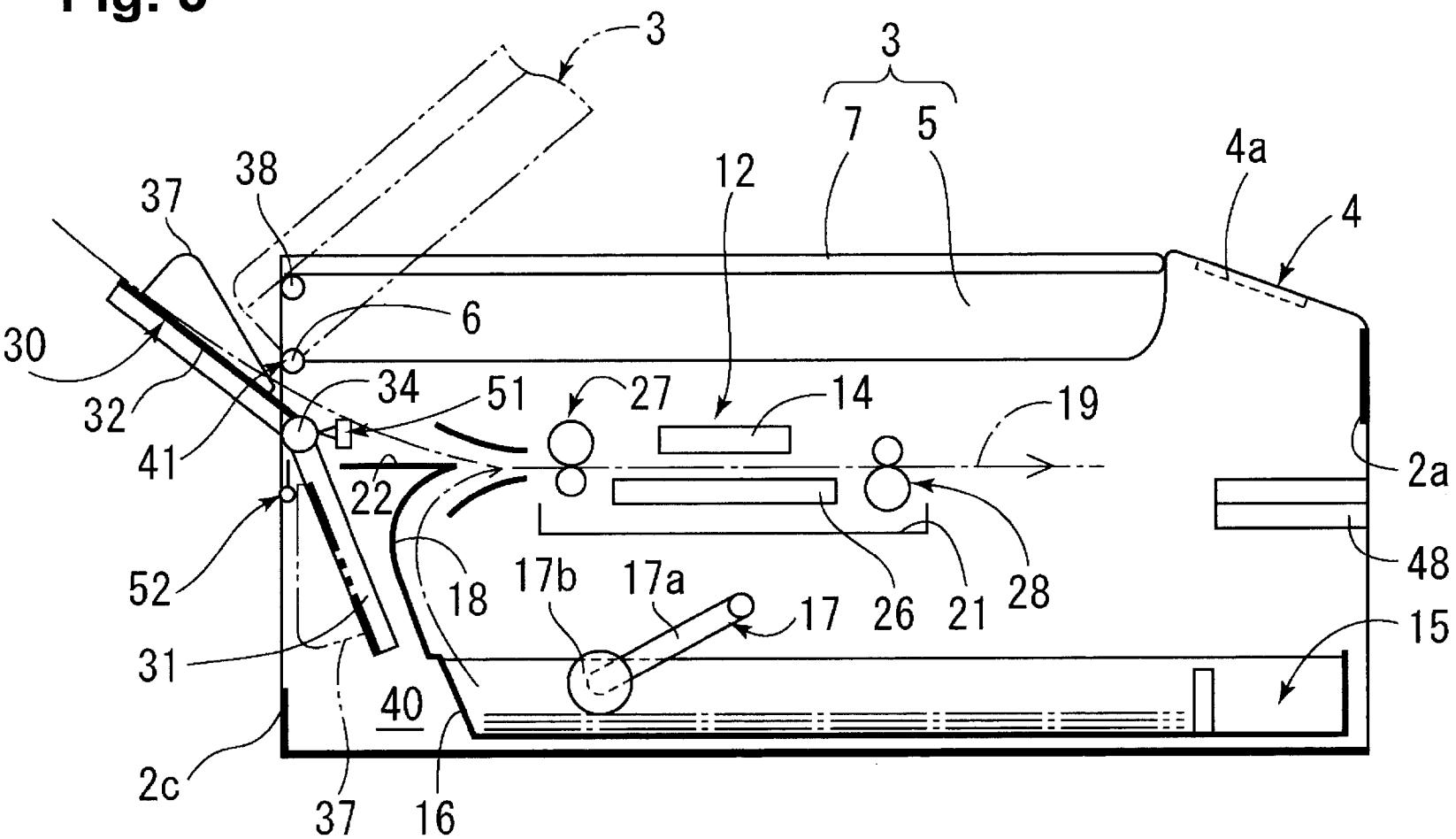
FIG. 3 is a schematic side view of the image printing apparatus according to a first example.

In contrast, as shown in FIG. 1 and FIG. 3, a paper feed cassette 15 (an example of a lower feed tray) configured to accommodate papers in an accumulated manner is arranged on a bottom portion of the housing 2 so as to be movable back and forth in an X-axis direction with respect to the front opening 2*a*. In this embodiment, the paper feed cassette 15 has a form to allow storage of a plurality of pieces of paper cut into A4 size, letter size, legal size, postcard size, and so on as the recording medium (paper) in a stacked (accumulated) state. One or more pieces of small-sized paper such as postcards can be placed on an auxiliary paper feed cassette (not shown) provided above the paper feed cassette 15 so as to be movable back and forth in the X-axis direction.

An inclined separation panel 16 for paper separation is arranged on an inner side of the paper feed cassette 15. A saw-tooth shaped resilient separation pad (not shown) for urging separation by coming into abutment with a leading end of the paper is provided at a center portion of the inclined separation panel 16 in the paper width direction.

A proximal end portion of a paper feed arm 17*a* of a paper feed unit 17 is mounted on the side of the housing 2 so as to be rotatable in the vertical direction, and rotation is transmitted from a drive source to a paper feed roller 17*b* provided at a distal end portion of the paper feed arm 17*a* by a tooth transmitting mechanism provided in the paper feed arm 17*a*. Then, the papers accumulated in the paper feed cassette 15 or the auxiliary paper feed cassette are selectively separated one by one and transported individually by the paper feed roller 17*b* and the resilient separation pad of the inclined separation panel 16. The separated paper is fed to the image printing unit 12 provided on an upper side (high position) of the paper feed cassette 15 via an U-shape path defined by a U-turn transporting unit 18 faced sideward and a substantially horizontal first transporting path 19.

The image printing unit 12 is supported by a box-shaped main frame 21 and a pair of left and right side panels thereof as shown in FIG. 3, and is formed between laterally elongated plate-shaped first and second guide members (not shown) extending in the Y-axis direction (primary scanning direction). A carriage having the ink-jet printhead 14 mounted on a lower surface thereof in the image printing unit 12 is slidably supported across the first guide member on an upstream side in the paper discharging direction and the second guide member on a downstream side thereof, and hence is reciprocally movable in the Y-axis direction.

In order to cause the carriage to make a reciprocal movement, a timing belt (not shown) is arranged so as to extend in the primary scanning direction (Y-axis direction) on an upper surface of the second guide member arranged on the downstream side in the paper discharging direction, and a CR (carriage) motor (not shown) that drives the timing belt is fixed to a lower surface of the second guide member.

A flat-shaped platen 26 extends in the Y-axis direction so as to face a lower surface of the printhead 14 of the carriage.

On the upstream side of the platen 26 in the paper discharge direction, a drive roller and a nip roller arranged below the drive roller so as to oppose thereto are arranged as a transporting (registration) roller pair 27 for transporting the paper to the underside of the printhead 14 as shown in FIG. 3. Also arranged on the downstream side of the platen 26 in the paper discharging direction is a paper discharge roller pair 28 including a paper discharge drive roller driven to transport the paper passed through the image printing unit 12 along the paper discharging direction and a spur roller urged toward the paper discharge drive roller so as to oppose thereto.

A paper discharge tray 20 in which the paper subjected to printing in the image printing unit 12 is discharged with a printed surface thereof faced upward is formed integrally on a front side of the auxiliary paper feed cassette (not shown), and a paper discharge port communicating with the paper discharge tray 20 is opened commonly with the front opening 2*a* of the housing 2.

[Configuration of First Manual Feed Tray]

Figure 5A:
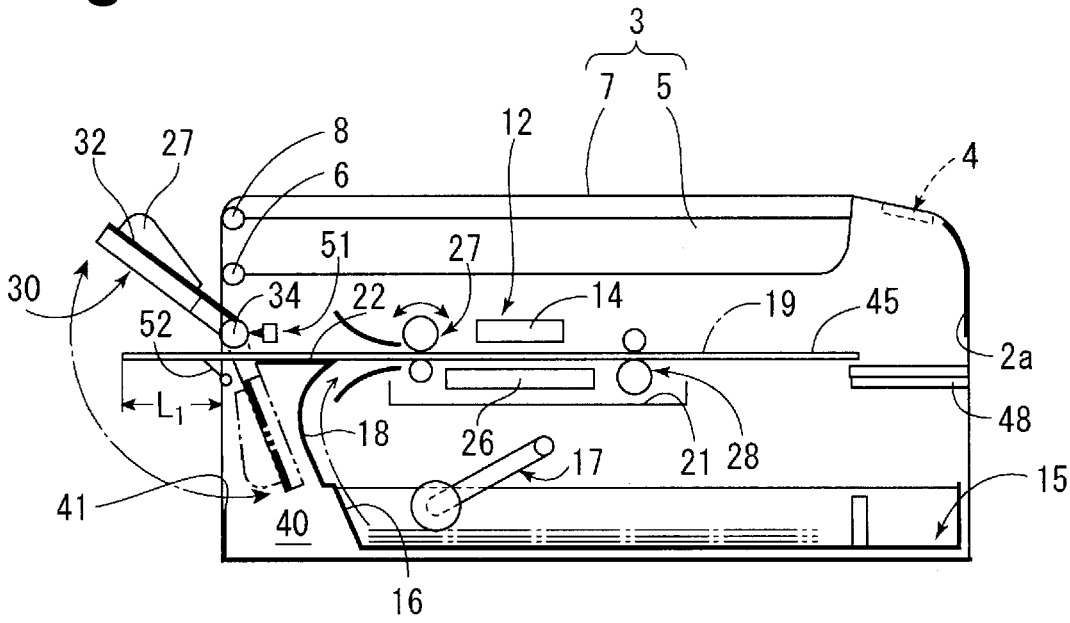
FIG. 5A is a schematic side view showing a state of printing using the specific tray.
Figure 5B:
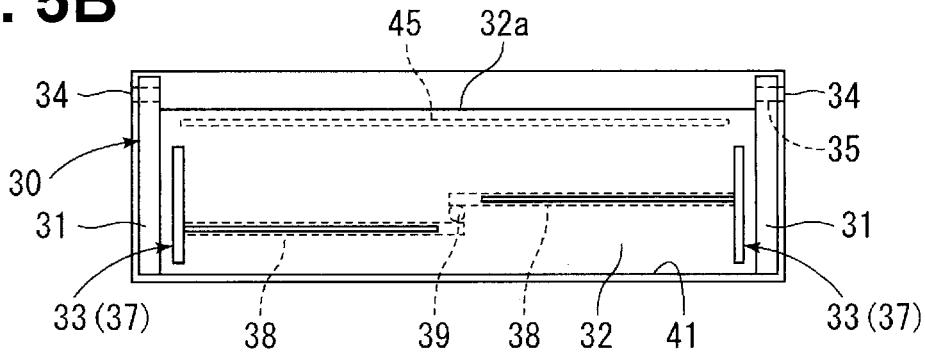
FIG. 5B is a schematic back view showing the state of printing using the specific tray.

Referring now to FIG. 3, FIG. 5A, and FIG. 5B, the configuration of the first example of a first manual feed tray 30 will be described.

The first manual feed tray 30 includes a pair of left and right arms 31, a placing panel 32 configured to connect the pair of arms 31, and side guides 33 provided on a front surface of the placing panel 32. Provided at proximal ends of the respective arms 31 are second hinge portions 34 for connecting the arms 31 to a back surface portion of the housing 2 so as to be rotatable in the vertical direction. The placing panel 32 is configured to place the printing medium to be manually fed, and an edge 32*a* of the placing panel 32 is positioned on the side close to axial centers 35 of the second hinge portions 34. The arms 31 are thicker than the placing panel 32.

In the first example, the first manual feed tray 30 is provided so as to be rotatable (pivotable) in the vertical direction about an axis of the second hinge portions 34. The second hinge portions 34 are set at positions on the side of an upper portion of a back side opening 41, which are slightly higher than a standard height of a second transporting path 22 and lower than the first hinge portions 6.

The side guides 33 include a pair of sliders apart from each other in the width direction, abutting panels 37 provided on the sliders so as to extend upright and hold both side edges of the printing medium in the width direction orthogonal to the feeding direction of the printing medium placed on the placing panel 32 from both sides so as to come into abutment therewith, rack rods 38 extending from the respective sliders in the width direction, and a pinion 39 rotatably provided on a lower surface of the placing panel 32 and engages the both rack rods 38. The abutting panels 37 are formed to increase in height from the placing panel 32 as they approach free ends of the arms 31. Conversely, the abutting panels 37 are formed to be lowered as they approach the second hinge portions 34. Therefore, they have a function as knobs which allow a user to hold and operate the abutting panels 37 with fingers easily.

The distance between the pair of the abutting panels 37 can be displaced in the wider and narrower direction by the user by holding one of the abutting panels 37 with his or her fingers and moving the same in the width direction of the printing medium. A lock member which is provided on a lower surface of the slider and is displaceable in engagement with engaging teeth formed on a back surface of the placing panel 32 (both not shown) is provided. Accordingly, the positions of the pair of abutting panels 37 can be maintained in a state in which a desired distance between the pair of abutting panels 37 is achieved.

The first manual feed tray 30 in use takes an obliquely upward position (an example of a feeding position and an example of a protruding position) on the outside of the back surface of the housing 2 (see the state indicated by a solid line in FIG. 3), and the recording medium on the first manual feed tray 30 can be fed to the substantially horizontal second transporting path 22 communicating with the first transporting path 19 and extending to a back surface 2*c* of the housing 2. The fed printing medium is transported from the second transporting path 22 to the image printing unit 12 via the registration roller pair 27, and is discharged from the first transporting path 19 to the front opening 2*a* after printing.

Provided on the back surface 2*c* of the housing 2 is the back side opening 41 which allows storage of the first manual feed tray 30 in a back side storage space 40 on a back side of the U-turn transporting unit 18 with a free end thereof faced downward. Therefore, when not in use, the first manual feed tray 30 can be stored in the back side storage space 40 on the back side with respect to the U-turn transporting unit 18 in a downwardly oriented position (an example of a retracted position), which is a position with the free end thereof faced downward (see the state indicated by a double-dashed chain line in FIG. 3). In this case, the entire unit of the side guides 33 of the first manual feed tray 30 is also stored in the back side storage space 40. A stopper (not shown) which can hold the oblique position of the first manual feed tray 30 when in use is provided.

According to the configuration as described above, the first manual feed tray 30 can be stored in the back side storage space 40 on the back side of the housing 2 when not in use without increasing the height of the housing 2 and, in contrast, a free end side of the first manual feed tray 30 approaches the upper surface of the upper body 3 when the first manual feed tray 30 is set to the position in use, so that visibility from an upper front side of the housing 2 for the user is advantageously ensured. Even when the upper body 3 is rotated in the opening direction about the first hinge portions 6 in a state in which the first manual feed tray 30 is stored in the back side storage space 40, the upper body 3 and the first manual feed tray 30 do not interfere with each other on the back side of the housing 2. In addition, when rotating the first manual feed tray 30 in a state of being stored in the back side storage space 40 to the position in use, the user can easily rotate the first manual feed tray 30 by holding a higher portion of the abutting panel 37 (a lower end side of the first manual feed tray 30 (free end side)).

Figure 4:
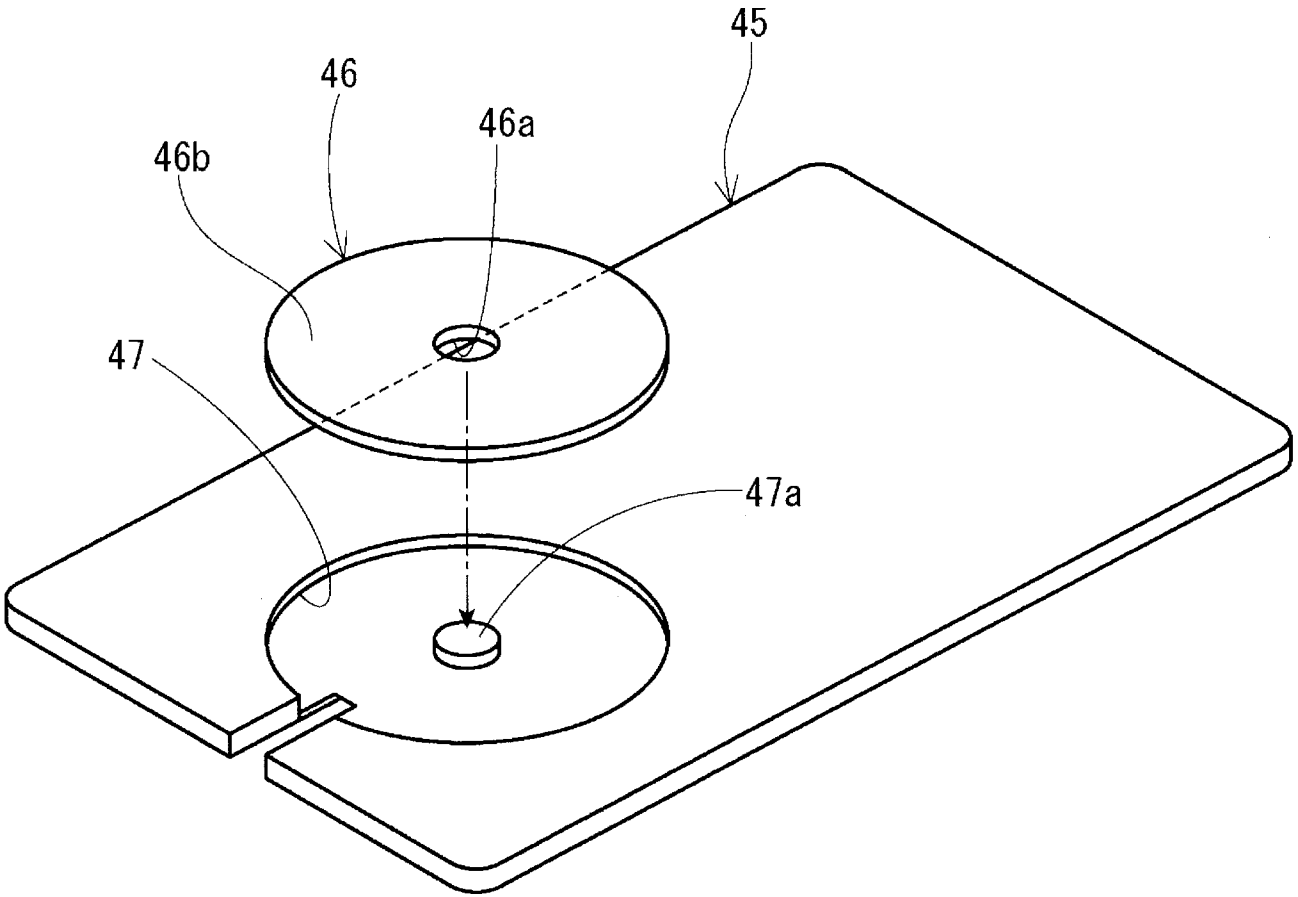
FIG. 4 is an exploded perspective view of a specific tray.

Referring now to FIG. 4, a specific tray (also referred to as a label tray) which allows so-called label printing on a surface of an optical disk such as a CD-R or a DVD as an example of a third printing medium will be described.

[Configuration of Specific Tray]

FIG. 4 is a schematic perspective view of a specific tray 45, and a circular groove 47 which allows setting of an optical disk 46 such as the CD-R and the DVD as an example of the third printing medium is formed on a front surface of the specific tray 45 formed of synthetic resin so as to be depressed therefrom. A projecting portion 47*a* which is fitted to a center hole 46*a* of the optical disk 46 is formed at a center portion of the circular groove 47 having the same diameter as the optical disk 46, and the projecting portion 47*a* has a height which is the same as a depth of the circular groove 47. A front surface of the optical disk 46 is a label printing area 46*b* which allows printing of a label such as a title with the printing unit 12. In contrast, a back surface of the optical disk 46 is a recording area for data such as images or music.

Provided on the side of the front opening 2*a* in the housing 2 is a auxiliary transporting unit 48 configured to support both sides of the specific tray 45 including the optical disk 46 set thereon in the width direction and transport the specific tray 45 in the direction of the printing unit 12 along the first transporting path 19 (see FIG. 5A).

At a position in preparation where the specific tray 45 is not set, the auxiliary transporting unit 48 stops in the housing at a position close to the front opening 2*a*. When a tray set command is supplied to the image printing apparatus 1, the auxiliary transporting unit 48 is slightly lowered and then is partly exposed toward the front from the front opening 2*a*. In this state, the specific tray 45 including the optical disk 46 set thereon is placed on the auxiliary transporting unit 48. Subsequently, when a label print preparation command is issued, the auxiliary transporting unit 48 is moved toward the printing unit 12. At this time, vertical distances between the drive rollers and the driven rollers (spur roller) of the registration roller pair 27 and the paper discharge roller pair 28, respectively, are increased, and the specific tray 45 is inserted into a gap therebetween. Then, the distances between the drive rollers and the driven rollers (spur roller) are decreased and hence the specific tray 45 is clamped between the upper and lower rollers, and is passed through the second transporting path 22 by the reverse rotation of the two drive rollers, whereby the specific tray 45 can be transported to the position in preparation where a trailing end of the specific tray 45 projects outward from the back side opening 41 of the housing 2 by an adequate distance L1 (see FIG. 5A). Subsequently, when a label print command is issued, printing on the label printing area 46*b* of the optical disk 46 placed on the specific tray 45 is performed while the two drive rollers rotate intermittently in the normal direction.

The edge 32*a* of the placing panel 32 of the first manual feed tray 30 is positioned closer to the axial centers 35 of the second hinge portions 34 and a standard position of the specific tray 45 extending along the second transporting path 22 is positioned downward of the edge 32*a* of the placing panel 32 of the first manual feed tray 30 in a state of facing downward. Therefore, after the trailing end of the specific tray 45 advances and hits against the back surface of the placing panel 32, the first manual feed tray 30 can be rotated upward in association with further advancement of the specific tray 45.

Figure 6:
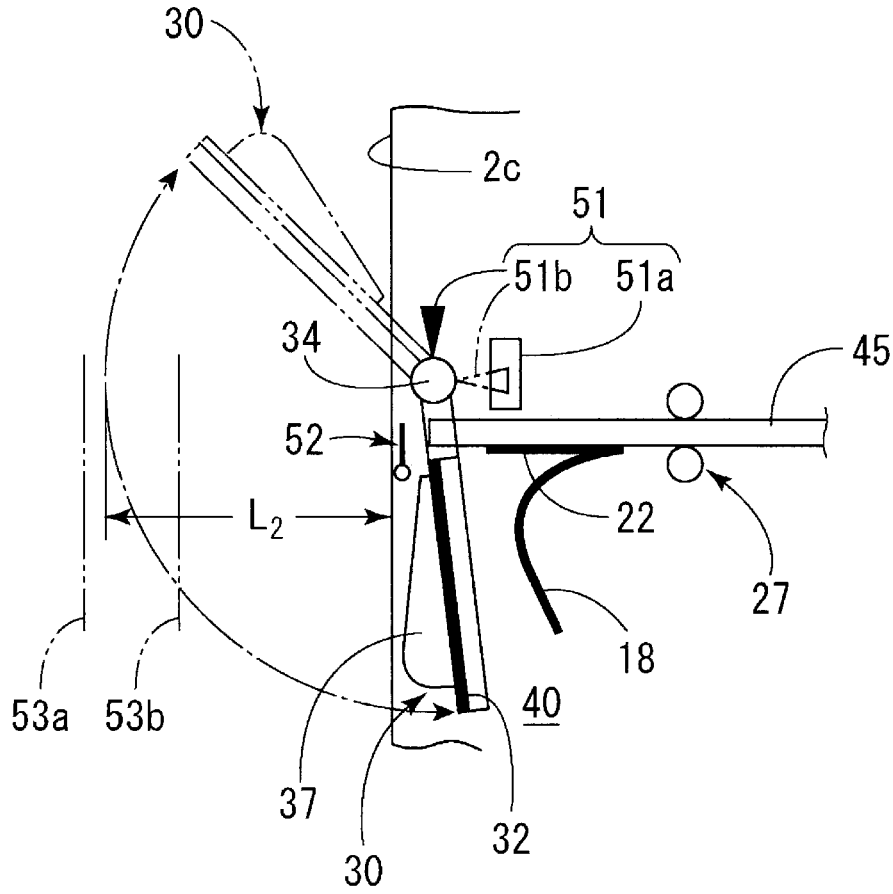
FIG. 6 is a schematic side view for explaining an operation.

The dimension L1 of outward projection of the trailing end of the specific tray 45 from the back side opening 41 of the housing 2 is set to be smaller than a maximum amount of projection L2 of a distal end (free end) of the first manual feed tray 30 when the first manual feed tray 30 is rotated upward from the stored position to the position in use, and to be smaller than the amount of projection of the distal end of the first manual feed tray 30 in the upward oblique position when in use (see FIG. 6).

Subsequently, detection of the position (rotated state) of the first manual feed tray 30 and presence or absence of insertion of the specific tray 45 into the housing 2, and a control unit 50 configured to perform an action of the image printing apparatus 1 on the basis of a detection signal therefrom will be described.

As shown in FIG. 3, FIG. 5A, and FIG. 6, a first sensor 51 for sensing the position (rotated state) of the first manual feed tray 30 is provided in the housing 2 in the vicinity of the second hinge portions 34 of the first manual feed tray 30. In contrast, a second sensor 52 which is capable of sensing whether or not the trailing end of the specific tray 45 inserted into the housing 2 projects from the back side opening 41 is provided in the housing 2 in the vicinity of the back side opening 41. As shown in FIG. 6, the first sensor 51 is a transmissive photo interrupter 51*a* or the like, and outputs an ON-OFF signal depending on the presence or absence of a detected portion 51*b* provided on a base portion of the first manual feed tray 30 so as to rotate integrally therewith.

In the example, the detected portion 51*b* intercepts light from the transmissive photo interrupter 51*a* (see the state indicated by a double-dashed chain line in FIG. 6) within a range of rotation from a position where the first manual feed tray 30 extends horizontally on the outside from the back surface (which corresponds to the maximum amount of projection L2) to a position where the first manual feed tray 30 is in use, that is, a position where the first manual feed tray 30 takes the oblique position, that is, a position where the free end side comes upper side on the outside of the back surface of the housing 2, so that the detection signal is "ON". In a range of rotation from a position where the first manual feed tray 30 is positioned with the free end side faced downward to a state in which the first manual feed tray 30 is accommodated in the interior of the storage space 40, the detected portion 51*b* is positioned outside of the transmissive photo interrupter 51*a* and hence does not interrupt the light (see the state indicated by a solid line in FIG. 6), the detection signal is "OFF".

The second sensor 52 provided in the second transporting path 22 is made up of a limit switch or the like, and when the trailing end of the specific tray 45 has passed through the second sensor 52 and is positioned on the outside of the back surface of the housing 2 (which corresponds to a printable position of the optical disk 46 on the specific tray 45), the detection signal is turned on. In the state therebefore, the detection signal is OFF.

Figure 7:
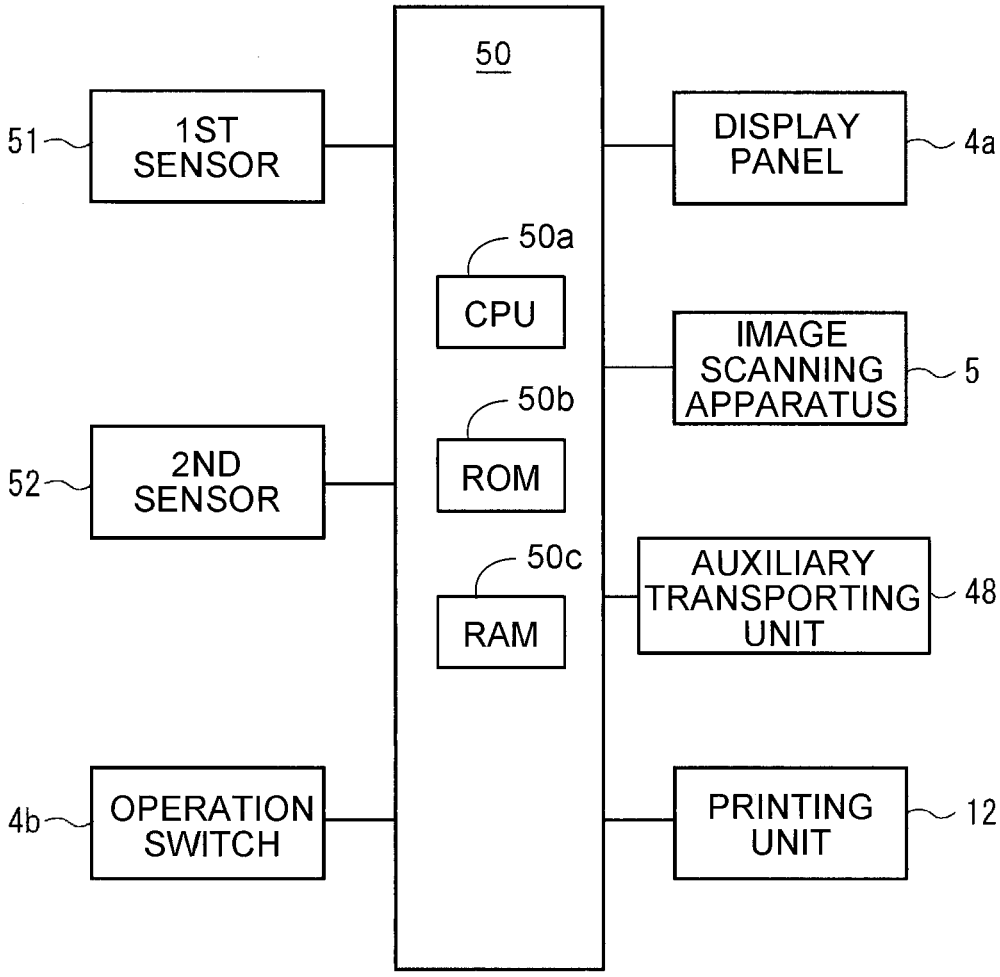
FIG. 7 is a block diagram of control.
Figure 8:
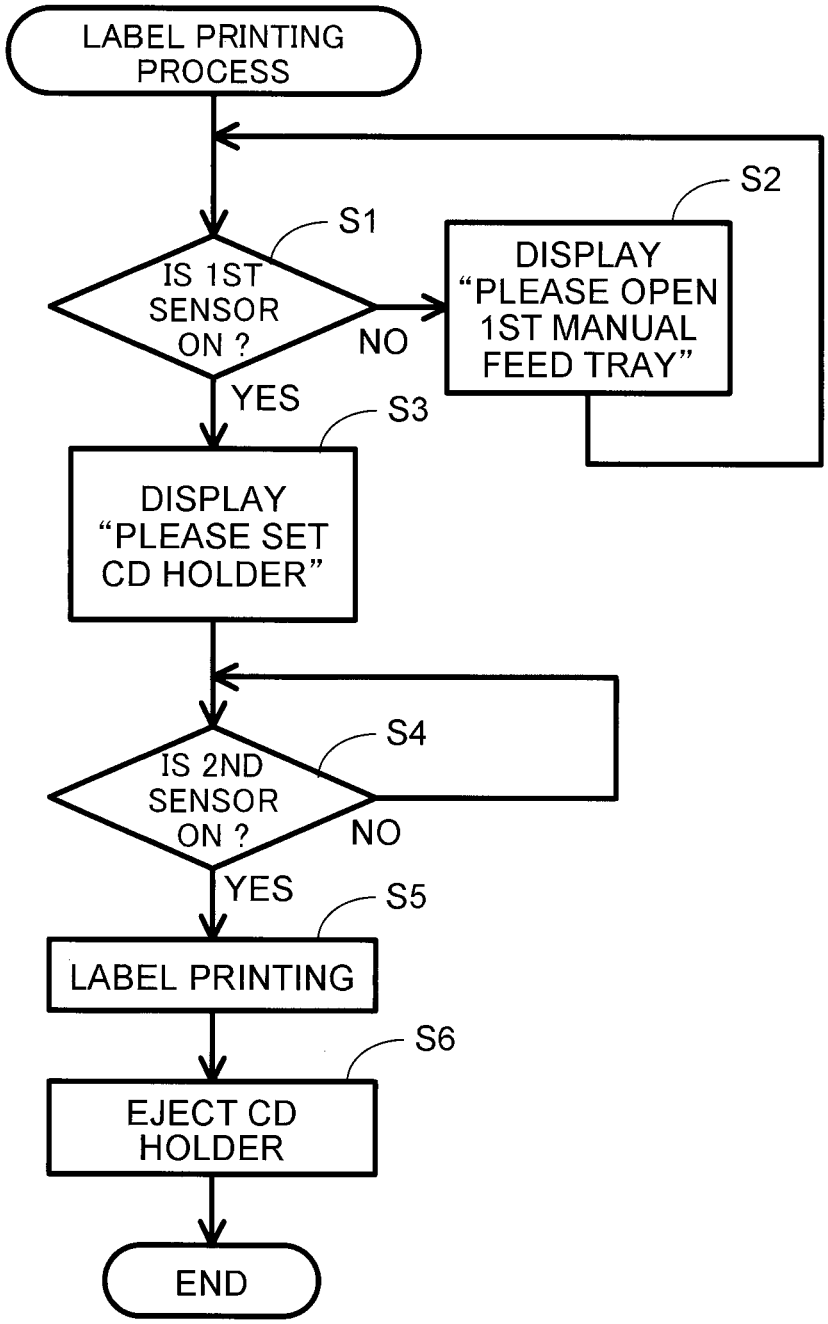
FIG. 8 is a flow chart showing a process of label printing.

FIG. 7 is a block diagram for control. The electronic control unit 50 such as a microcomputer is provided with a CPU 50*a*, a ROM 50*b* having a control programs stored therein and a RAM 50*c* for storing various data such as the detection signal therein, although they are not shown in the drawings. The first sensor 51, the second sensor 52, the operating switch 4*b*, the display panel 4*a*, the image scanning apparatus 5, the printing unit 12, and the auxiliary transporting unit 48 described above are connected to the control unit 50.

Subsequently, a mode of control by the control unit 50 will be described. As shown in a flowchart in FIG. 8, in a subroutine of a label printing process, whether or not the first sensor 51 is ON is determined first. If the user takes out the first manual feed tray 30 from the storage space 40, rotates upward, and sets the first manual feed tray 30 from the horizontal state to the usable state (state of being inclined obliquely upward), the first sensor 51 is determined to be ON (S1: yes). As shown in FIG. 6, the amount of projection when the first manual feed tray 30 is in the horizontal state is the maximum amount of projection L2. Therefore, by setting the image printing apparatus 1 at a position securing a horizontal distance between other objects (wall, etc.) 53*a* and the back surface 2*c* of the housing 2 to be larger than L2, the vertical rotation of the first manual feed tray 30 is not hindered. In contrast, is a horizontal distance between other objects (wall, etc.) 53*b* and the back surface 2*c* of the housing 2 is smaller than L2, the free end of the first manual feed tray 30 which is coming out from the storage space 40 is supported by the other objects (wall, etc.) 53*b*, so that the first sensor 51 is kept in an OFF state. In this case (S1: no), a massage "Open First Manual Feed Tray" is displayed (S2) on the display panel 4*a*. Therefore, the user inspects the position of the first manual feed tray 30.

The action to rotate the first manual feed tray 30 upward may be insertion of the specific tray 45 (referred as CD Holder in a flowchart provisionally) from the front opening 2*a* of the housing 2. In this case, as shown in FIG. 6, the trailing end of the specific tray 45 presses the back surface of the placing panel 32 of the first manual feed tray 30 faced downward, and pushes the first manual feed tray 30 upward about the second hinge portions 34. Anyhow, when the first sensor 51 is in an ON state (S1: Yes), a message "Set CD Holder" is displayed on the display panel 4*a* (S3). Since when the trailing end of the specific tray 45 (CD Holder) projects from the back surface of the housing 2 by the predetermined amount L1, the second sensor 52 is turned ON (S4: Yes), it is determined that printing on the optical disk 46 is possible, so that the label printing on the optical disk 46 on the specific tray 45 is performed (S5). When the label printing on one optical disk 46 is finished, the auxiliary transporting unit 48 is activated automatically, and the specific tray 45 (CD Holder) is ejected out from the front opening 2*a* of the housing 2 (S6).

With the control as described above, by securing a horizontal distance between a back surface of the image printing apparatus 1 and other objects such as a wall of a room to be slightly larger than the maximum amount of projection L2 of the first manual feed tray 30 at a position of installation of the image printing apparatus 1, the first sensor 51 and the second sensor 52 are both turned ON by inserting the specific tray 45 (CD Holder) using the auxiliary transporting unit 48, so that the label printing on the optical disk 46 is performed safely, reliably, and quickly. In addition, the other objects do not hinder the upward rotation of the first manual feed tray 30 or the projection of the trailing end of the specific tray 45 later, so that removal of hindrance of the label printing using the specific tray 45 is ensured.

Also, by holding the first manual feed tray 30 at a working position, manual feed printing using the first manual feed tray 30 can be performed in the state shown in FIG. 3. In this case, with the first manual feed tray 30 in the position in use, it is preferable that an upper side of an auxiliary horizontal guide plate extending from an upper end of the U-turn transporting unit 18 toward the back side opening 41 forms the second transporting path 22 so that the printing medium placed on the placing panel 32 is guided smoothly from the second transporting path 22 to the registration roller pair 27 (see FIG. 5A, FIG. 6).

As another embodiment, an auxiliary placing panel (not shown) for supporting a trailing end of the printing medium may be provided so as to be expandable or foldable in the first manual feed tray 30.

It is needless to say that the invention can be applied not only to the multifunctional image printing apparatus 1, but also to a single-function image printing apparatus. In this case as well, the invention achieves the effects and advantages as described above.

In the embodiments described above, the first sensor 51 detects the position of the first manual feed tray 30. Therefore, the first sensor 51 and the first manual feed tray 30 serves as a detecting device which detects whether a space is existing outside the apparatus. Alternatively, a sensor which detects whether the space is existing or not by detecting an object within a predetermined distance from the sensor can be applied. For example, the sensor may be configured to detect a light reflected from the object.

What is claimed is:

1. An image printing apparatus comprising:

an image printing unit;

a manual feed tray configured to receive a first printing medium to be fed, the manual feed tray being movable between a feeding position where the first printing medium can be fed and a retracted position;

a feeding mechanism configured to feed a specific tray, on which a second printing medium is mounted, from an inlet to the image printing unit through a first path, and to feed the first printing medium received by the manual feed tray to the image printing unit through a second path different from the first path;

a sensor configured to detect a current position of the manual feed tray; and a controller configured to control the feeding mechanism and the image printing unit to perform printing on the second printing medium mounted on the specific tray on the basis of the current position of the manual feed tray detected by the sensor, wherein the feeding mechanism is configured to feed the specific tray such that an end of the specific tray moves along the first path and further moves over the image printing unit and along the second path, and wherein the end of the specific tray protrudes outside from the apparatus when the printing on the second printing medium mounted on the specific tray is performed.

2. The image printing apparatus according to claim 1, wherein the controller is configured to control the feeding mechanism and the image printing unit to perform printing on the second printing medium mounted on the specific tray when the current position of the manual feed tray detected by the sensor is the feeding position, and not to perform printing on the second printing medium mounted on the specific tray when the current position of the manual feed tray detected by the sensor is not the feeding position.

3. The image printing apparatus according to claim 1, wherein the end of the specific tray protrudes over a position where the manual feed tray in the retracted position is occupying.

4. The image printing apparatus according to claim 3, wherein the manual feed tray is movable from the feeding position to the retracted position by pivoting downward.

5. The image printing apparatus according to claim 4, wherein the end of the specific tray protrudes outside by moving under an axis about which the manual feed tray pivots.

6. The image printing apparatus according to claim 1, wherein a protruding amount of the specific tray from the apparatus is smaller than a maximum protruding amount of the manual feed tray to the outside of the apparatus body.

7. The image printing apparatus according to claim 1, wherein the manual feed tray extends obliquely upward relative to a horizontal direction when the manual feed tray is in the feeding position.

8. The image printing apparatus according to claim 1, further comprising a further sensor configured to determine whether or not the specific tray is fed to a printing position where the printing on the second printing medium mounted on the specific tray is performed.

9. The image printing apparatus according to claim 1, further comprising a lower feed tray disposed below the image printing unit and configured to support a third printing medium, wherein the feeding mechanism is configured to feed the third printing medium to the image printing unit through an U-shape path.

10. The image printing apparatus according to claim 9, wherein the manual feed tray is movable from the feeding position to the retracted position by pivoting downward and, when the manual feed tray is in the retracted position, the manual feed tray is adjacent to the U-shape path.

11. The image printing apparatus according to claim 1, wherein the second printing medium is a disk.

12. An image printing apparatus comprising:

an image printing unit;

a feeding mechanism configured to feed a specific tray, on which a printing medium is mounted, from an inlet to the image printing unit in a first direction;

a detecting device configured to detect whether a space is existing outside the apparatus in the first direction; and a controller configured to control the feeding mechanism and the image printing unit to perform printing on the printing medium mounted on the specific tray when the detecting device detects that the space is existing, and not to perform printing on the printing medium mounted on the specific tray when the detecting device detects that the space is not existing.

13. The image printing apparatus according to claim 12, wherein the detecting device comprises:

a manual feed tray configured to receive a further printing medium to be fed, the manual feed tray is movable between a protruding position where manual feed tray is protruding outside and a retracted position where the manual feed tray retracted relative to the protruding position, and a sensor for detecting whether or not the manual feed tray is in the protruding position, wherein the detecting device is configured to detect that the space is existing outside the apparatus when a detection signal of the sensor indicates that the manual feed tray is in the protruding position.

14. The image printing apparatus according to claim 12, wherein the printing medium is a disk.

* * * * *